US005380611A

United States Patent [19]

Landa

[11] Patent Number: 5,380,611

[45] Date of Patent: Jan. 10, 1995

[54] LIQUID DEVELOPER SYSTEMS FOR IMAGING ON TRANSPARENT AND OPAQUE SUBSTRATES

[75] Inventor: Benzion Landa, Edmonton, Canada

[73] Assignee: Indigo N.V., SM Veldhoven, Netherlands

[21] Appl. No.: 989,020

[22] PCT Filed: Sep. 19, 1990

[86] PCT No.: PCT/NL90/00136

§ 371 Date: Mar. 12, 1993

§ 102(e) Date: Mar. 12, 1993

[87] PCT Pub. No.: WO92/05477

PCT Pub. Date: Apr. 2, 1992

[51] Int. Cl.[6] ..... G03G 15/01

[52] U.S. Cl. ..... 430/45; 430/126; 355/326 R

[58] Field of Search ..... 430/45, 44, 47, 117, 430/119, 126; 355/326

[56] References Cited

U.S. PATENT DOCUMENTS

| | | | |
|---|---|---|---|
| 3,862,848 | 1/1975 | Marley | 355/10 |
| 3,863,603 | 2/1975 | Buckley et al. | 118/637 |
| 3,893,761 | 7/1975 | Buchan et al. | 355/3 Q |
| 3,959,574 | 5/1976 | Seanor et al. | 428/425 |
| 4,439,035 | 3/1984 | Landa | 355/15 |
| 4,531,825 | 7/1985 | Miwa et al. | 355/3 TR |
| 4,684,238 | 8/1987 | Till et al. | 355/10 |
| 4,690,539 | 9/1987 | Radulski et al. | 355/3 R |
| 4,794,651 | 12/1988 | Landa et al. | 430/110 |
| 4,927,725 | 5/1990 | Nishide et al. | 430/47 |
| 5,234,784 | 8/1993 | Aslam et al. | 430/45 |

*Primary Examiner*—John Goodrow
*Attorney, Agent, or Firm*—Sandler Greenblum & Bernstein

[57] ABSTRACT

A method for providing an image on either opaque or transparent substrates (42) to have substantially equal apparent color saturation when viewed and including the steps of: developing a latent electrostatic image on an image bearing surface (16) using a colored liquid developer in a developer system operating at given voltages; and subsequently transferring the image to the substrate (42) wherein said liquid developer, developer system and voltages are the same for printing on both opaque and transparent substrates. The method utilizes a control apparatus, operative when the substrate (42) sought to be printed is transparent, for causing each toner image to be developed on an image bearing surface (16) and transferred to an intermediate transfer member (40) a plurality of times, before the image is transferred therefrom to the transparency, and when the substrate (42) sought to be printed in opaque, for causing each toner image to be developed on the image bearing surface (16) and transferred to the intermediate transfer member (40) only once, before the image is transferred therefrom to the opaque substrate.

30 Claims, 1 Drawing Sheet

LIQUID DEVELOPER SYSTEMS FOR IMAGING ON TRANSPARENT AND OPAQUE SUBSTRATES

FIELD OF THE INVENTION

The present invention relates to image transfer techniques and apparatus for use in electrostatic imaging using an intermediate transfer member.

BACKGROUND OF THE INVENTION

The use of an intermediate transfer member in electrostatic imaging is well known in the art.

Various types of intermediate transfer members are known and are described, for example in U.S. Pat. Nos. 3,862,848, 4,684,238, 4,690,539 and 4,531,825.

Belt-type intermediate transfer members for use in electrophotography are known in the art and are described, inter alia, in U.S. Pat. Nos. 3,893,761, 4,684,238 and 4,690,539.

The use of intermediate transfer members is well known in the printing art. In offset printing an image formed of a viscous ink is transferred from a drum to a second drum prior to transfer to the final substrate.

Conventional color electrostatic printers print three or four, partly transparent, color, generally half-tone, separations in cyan, magenta, yellow and (optionally) black to form a single full color image. The color density of these single color prints must be carefully controlled to produce the correct color in the final image.

An observer viewing an image printed on paper actually sees a color which is the result of light incident on the image, which passes through the image, is reflected from the paper and passes through the image again before being seen by the viewer. The light which the observer sees is thus filtered twice by the image. If the same conditions are used for printing on transparencies the colors appear to be washed out, i.e., they have a lower saturation than the same print on paper. This reduced saturation is caused by the fact that for transparencies light passes through the printed image only once before being viewed.

SUMMARY OF THE INVENTION

The present invention seeks to provide apparatus and techniques for improved electrostatic printing of transparencies. In a preferred embodiment of the invention transparencies and prints on opaque substrates can be produced utilizing the same developer system operating at the same voltages and utilizing the same developer liquid.

There is thus provided apparatus for electrostatic printing of transparencies including:

an image bearing surface;

an intermediate transfer member operative for transfer of toner images from the image bearing surface to a transparency;

apparatus for causing each toner image to be developed on the image bearing surface and transferred to the intermediate transfer member a plurality of times, before the image is transferred to the transparency, thereby to enhance the color density of the transparency.

In a preferred embodiment of the invention the transparencies are polychromatic transparencies and each color separation is imaged and developed on the image bearing surface and transferred to the intermediate transfer member at least twice before the combined superimposed image for that color separation on the intermediate transfer member is transferred to the transparency.

In a preferred embodiment of the invention, the apparatus for causing is operative, when the image is to be transferred to an opaque substrate, for causing each toner image to be developed on the image bearing surface and transferred to the intermediate transfer member only once, before the image is transferred to the opaque surface thereby to result in a color density substantially the same as that for a transparency.

There is further provided a method for electrostatic printing of transparencies including the steps of:

providing an electrostatic image on an electrostatic image bearing surface;

developing the image on the electrostatic image bearing surface;

transferring the developed image to an intermediate transfer member;

carrying out the foregoing steps at least twice for each image; and subsequently transferring the developed image built up on the intermediate transfer member to the transparency, thereby to enhance the color density of the transparency.

In a preferred embodiment of the invention the transparencies are polychromatic transparencies and each color separation is imaged and developed on the image bearing surface and transferred to the intermediate transfer member at least twice before the combined superimposed image for that color separation on the intermediate transfer member is transferred to the transparency.

The is further provided apparatus for providing an image on opaque or transparent substrates including:

an image bearing surface adapted to support latent images thereon;

an intermediate transfer member operative for transfer of toner images from the image bearing surface to a transparency;

sensing apparatus for sensing whether a substrate sought to be printed is transparent;

control apparatus, operative when the substrate sought to be printed is transparent, for causing each toner image to be developed on the image bearing surface and transferred to the intermediate transfer member a plurality of times, before the image is transferred therefrom to the transparency, thereby to enhance the color density of the transparency.

In a preferred embodiment of the invention the control apparatus is operative, when the substrate sought to be printed is opaque, for causing each toner image to be developed on the image bearing surface and transferred to the intermediate transfer member only once, before the image is transferred therefrom to the opaque substrate.

There is further provided a method for providing an image on either opaque or transparent substrates to have substantially equal apparent color saturation when viewed and including the steps of:

developing a latent electrostatic image on an image bearing surface using a colored liquid developer in a developer system operating at given voltages; and subsequently transferring the image to the substrate, wherein the liquid developer, developer system and voltages are the same for printing on both opaque and transparent substrates.

There is further provided apparatus for providing an image on either opaque or transparent substrates having substantially equal apparent color saturation when viewed, and including:

an image bearing surface having an electrostatic latent image thereon;

an electrostatic development system operating at a given development voltage and utilizing a given liquid toner for developing said electrostatic image; and apparatus for transferring the developed image to the substrate, wherein the liquid developer, development system and voltages are the same for printing on both opaque and transparent substrates.

BRIEF DESCRIPTION OF THE DRAWINGS

The present invention will be understood and appreciated more fully from the following detailed description, taken conjunction with the drawing in which.

DETAILED DESCRIPTION OF A PREFERRED EMBODIMENT

Figure 1:
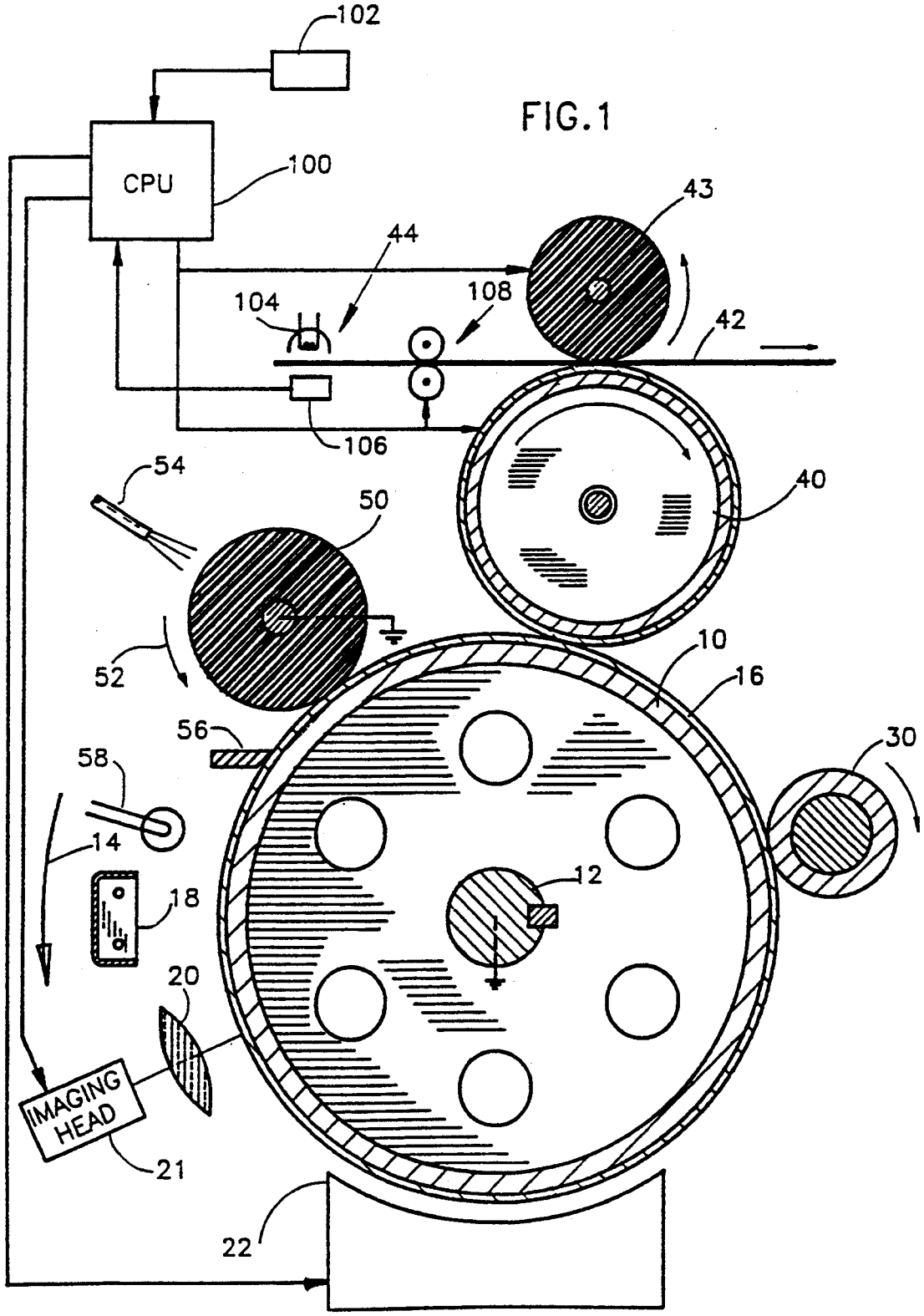
FIG. 1 is a simplified sectional illustration of electrostatic imaging apparatus constructed and operative in accordance with a preferred embodiment of the present invention.

Reference is now made to FIG. 1, which illustrates electrostatic imaging apparatus constructed and operative in accordance with a preferred embodiment of the present invention.

In a preferred embodiment of the invention the toner Example 1 of U.S. Pat. No. 4,794,651 which is incorporated herein by reference, is employed, but a variety of powder liquid toner types are useful in the practice of the invention. For colors other than black, the carbon black in the toner particles is replaced by suitable pigments as known in the art.

As in conventional electrophotographic systems, the apparatus of FIG. 1 comprises a drum 10 arranged for rotation about an axle 12 in a direction generally indicated by arrow 14. The drum 10 is formed with a cylindrical photoconductive surface 16.

A corona discharge device 18 is operative to generally uniformly charge the photoconductor surface 16 with positive charge. Continued rotation of the drum 10 brings the charged photoconductor surface 6 into image receiving relationship with an exposure unit including a lens 20, which focuses a desired image onto the charged photoconductive surface 16, selectively discharging the photoconductive surface, thus producing an electrostatic latent image thereon. Lens 20 may be the lens of a photocopier, as illustrated, or alternatively, for example, the lens of a laser printer.

Continued rotation of the drum 10 brings the charged photoconductive surface 16 bearing the electrostatic latent image into a development unit 22, which is operative to apply a colored toners, such as a liquid developer comprising carrier liquid and colored toner particles to develop the electrostatic latent image. Preferred development systems are described in commonly assigned PCT patent application PCT/NL90/00069 filed May 14, 1990 and U.S. Patent Application entitled LIQUID DEVELOPER SYSTEM which was filed on Aug. 22, 1990, the disclosures of which are incorporated herein by reference. Other multicolor liquid toner development systems as known in the art may also be suitable.

Downstream of roller 26 there is preferably provided a rigidizing roller 30. The rigidizing roller 30 is preferably formed of a resilient polymeric material, such as conductive resilient polymeric materials as described in either or both of U.S. Pat. Nos. 3,959,574 and 3,863,603 the disclosures of which are incorporated herein by reference, and is preferably maintained in contacting, pressured relationship with the photoconductive surface 16. Use of such rigidizing rollers in systems comprising intermediate transfer members is described in commonly assigned U.S. patent application Ser. No. 7/306,076, filed Jun. 2, 1989, the disclosure of which is incorporated herein by reference.

Downstream of rigidizing roller 30 there is provided an intermediate transfer member 40, which rotates, as shown by arrow 41, in a sense opposite to that of drum 10, and is operative for receiving the toner image from surface 16 and for transferring the toner image to a receiving substrate 42, such as paper or a transparency, which is supported by a roller 43. In accordance with a preferred embodiment of the invention, intermediate transfer member 40 is configured and mounted with respect to drum 10 for providing first transfer engagement between intermediate transfer member 40 and image bearing photoconductor surface 16 for transfer of an image from surface 16 to intermediate transfer member 40.

The configuration and arrangement of intermediate transfer member 40, substrate 42 and roller 43 is preferably such as to provide second transfer engagement between the intermediate transfer member 40 and the substrate 42 for transfer of the image from the intermediate transfer member 40 to the substrate 42.

Intermediate Transfer Members and methods for using same which are especially useful for carrying out the present invention are described in commonly assigned U.S. patent application Ser. No. 7/446,877 filed Dec. 26, 1989, the disclosure of which is incorporated herein by reference, and in the above mentioned PCT patent application PCT/NL90/00069 filed May 14, 1990.

Control apparatus 46 is provided, for governing the operation of the remainder of the apparatus of FIG. 1. In general when it is sought to print on a transparencies, each monochromatic image or each color separation of a polychromatic image is developed more than once. In a preferred embodiment of the invention, each separation is imaged, developed and transferred to intermediate transfer member 40 more than once before the second transfer to the transparent substrate occurs.

The control apparatus typically comprises a Central Processing Unit (CPU) 100, such as a microcontroller or a microprocessor. Since the control function described hereinbelow with reference to the present invention is very simple, CPU 100 will generally perform all of the control functions of the imaging machine, and the control functions described below may involve no more than a few lines of code.

CPU 100 typically receives input signals from either an operator controlled paper-transparency switch 102 or from apparatus 44 for indicating whether a substrate sought to be printed is opaque, such as paper, or transparent. Typically apparatus 44 will shine light through the medium to be printed from a light source 104. If a relatively large amount of light is measured on a light detector 106, a transparency is to be printed on. Otherwise, a piece of paper is to be printed on.

In response to the signal from switch 102 or light detector 106, CPU 100 activates the following elements of the apparatus of the present invention; developer 22, imaging head 21, intermediate transfer member 40, a paper feeder 108 and backing roller 43.

The operation of color developers, imaging heads and intermediate transfer members is well known in the art. For the preferred embodiments which are described in documents incorporated herein by reference, the operation is described in those documents.

A preferred method of activation is as follows:

1) Imaging head 21 is activated to write a latent image representing a particular color onto photoreceptor 16.

2) Developer 22 is activated to develop the latent image on photoreceptor 16 using the proper color developer.

3) Intermediate transfer member 40 and photoreceptor 16 are activated to transfer the developed image from photoreceptor 16 to intermediate transfer member 40.

4) Steps 1–3 are repeated for each of the colors to be printed.

If an input signal to CPU 100 indicates that a piece of paper is present, then step 5 is performed. Otherwise, step 6 is performed.

5) CPU 100 activates the paper feed 108 to feed the piece of paper between backing roller 43 and intermediate transfer member 40 to cause the developed image to be transferred to the piece of paper.

6) CPU 100 causes steps 1–4 to be repeated. It then effects step 5.

The toner is formulated, as is known in the art, to give proper color saturation when the image is printed on paper. The present apparatus and procedure is operative to produce prints on paper and transparencies having roughly equally saturated colors for the following reason: When a print on white paper is viewed, the observer actually sees light which has passed through the image once, been reflected from the paper, and then passed through the image a second time. Thus the incident, white, light is filtered twice by the printed layer. For transparencies, the printed layer for each color is twice as thick as the printed layer for paper prints. Thus while in projecting transparencies, light passes through the printed image only once, the effective filtration of the is equal to that for the printed image, yielding similar saturation densities.

It is understood that this method does not require any changes in the development process itself or in the liquid developer when a transparency is produced. Any such changes result in complication of the apparatus and process and in uncertain results.

Following transfer of the developed toner image to the intermediate transfer member, photoconductive surface 16 is engaged by a cleaning roller assembly 50, including a pair of rollers 52, which typically rotate in opposite directions, and a nozzle 54. The cleaning roller assembly 50 is operative to scrub clean the surface 16. A cleaning material, such as liquid developer, may be supplied to the assembly 50 via nozzle 54. A suitable cleaning assembly is illustrated in U.S. Pat. No. 4,439,035, the specification of which is incorporated herein by reference. Any residual charge left on the photoconductive surface 16 is removed by flooding the photoconductive surface 16 with light from a lamp 58.

It will be appreciated by persons skilled in the art that the present invention is not limited by what has been particularly shown and described hereinabove. Rather the scope of the present invention is defined only by the claims which follow:

I claim:

1. Apparatus for providing, on either opaque or transparent substrates, images having substantially equal apparent color saturation when viewed, comprising:

a marking device operative to deposit a given amount of colored material in an imagewise configuration thereon during marking process;

control apparatus operative when the substrate on which the image is to be printed is transparent, that causes the marking device to repeat the marking process, whereby approximately twice the given amount of colored material is deposited thereon when the substrate is transparent.

2. Apparatus according to claim 1 wherein the marking device comprises:

an image bearing surface having an electrostatic latent image formed thereon; and a developer operative to develop the latent image to form a given developed image, and the control apparatus is operative, when the substrate is transparent, to form a second developed image, essentially identical to the given developed image on the image bearing surface.

3. Apparatus according to claim 2 comprising:

means for transferring the developed image to the substrate, and the control apparatus is operative, when the substrate is transparent, to cause the means for transferring to transfer the second developed image to the substrate.

4. Apparatus according to claim 3 wherein the means for transferring comprises an intermediate transfer member for receiving the developed image from the image bearing surface before the image is transferred to the transparency.

5. Apparatus according to claim 4 and wherein the control apparatus is operative, when the image is a polychromatic image comprising color separations and the substrate is transparent, for causing said second developed images for each color separation to be transferred, in superposition on the given developed image of that separation, to the intermediate transfer member, and then transferring the combined superimposed images for that separation on the intermediate transfer member to the transparency.

6. Apparatus according to claim 4 and wherein said control apparatus is operative, when the substrate is transparent, for causing said second developed images to be transferred, in superposition on the given image, to the intermediate transfer member, and then transferring the combined superimposed image on the intermediate transfer member to the transparency.

7. Apparatus according to claim 3 wherein the developing apparatus is operative to cause the latent image to be developed utilizing a liquid developer comprising charged toner particles and carrier liquid.

8. A method for providing, on either opaque or transparent substrates, images having substantially equal apparent color saturation when viewed and comprising the steps of:

marking the substrate by depositing a given amount of colored material thereon during an imaging process; and duplicating the step of marking thereby to deposit approximately twice the given amount of pigmented material thereon when the substrate is transparent.

9. A method according to claim 6 wherein the step of marking includes the steps of:

(a) providing an electrostatic image on an electrostatic image bearing surface; and (b) developing the image on the electrostatic image bearing surface to form a developed image, and the step of duplicating includes:

carrying out steps (a) and (b) at least twice for each image.

10. A method according to claim 7 wherein the step of marking further includes the step of:

(c) transferring the developed image to the substrate.

11. A method according to claim 10 wherein the step of transferring includes, when the substrate is transparent, the steps of:

transferring the separate developed images to an intermediate transfer member to form a built up superimposed image; and subsequently transferring the superimposed image from the intermediate transfer member to the transparent substrate, thereby to enhance a resulting color density of the transparency.

12. A method according to claim 11 wherein said transparency is a polychromatic transparency and each color separation is imaged and developed on the image bearing surface and transferred to the intermediate transfer member at least twice before the combined superimposed image for that color separation on the intermediate transfer member is transferred to the transparent substrate.

13. A method according to claim 8 wherein the step of developing includes using liquid developer to develop the latent image.

14. A method for providing an image on either opaque or transparent substrates comprising the steps of:

developing a latent electrostatic image on an image bearing surface using a colored liquid developer in a developer system operating at given voltages; and subsequently transferring the image to the substrate, wherein said liquid developer, developer system and voltages are the same for printing on both opaque and transparent substrates and wherein the images on the opaque and transparent substrates have substantially equal apparent color saturation when the opaque substrates are directly viewed and the transparent substrate is viewed by projection.

15. Apparatus for providing an image on either opaque or transparent substrates comprising:

an image bearing surface having an electrostatic latent image thereon;

an electrostatic development system operating at a given development voltage and utilizing a given liquid toner for developing said electrostatic image; and means for transferring the developed image to the substrate, wherein said liquid developer, development system and voltages are the same for printing both opaque and transparent substrates; and wherein the apparatus provides images on the opaque and transparent substrates having substantially equal apparent saturation when the opaque substrates are directly viewed and the transparent substrate is viewed by projection.

16. Apparatus according to claim 4 wherein the developer operates at a given development voltage for developing said electrostatic latent image, and the developer and the voltages are the same for printing on both opaque and transparent substrates and the apparatus provides images on the opaque and transparent substrates that have substantially equal apparent color saturation when the opaque substrates are directly viewed and the transparent substrates are viewed by projection.

17. Apparatus according to claim 4 wherein the developer operates at a given development voltage for developing said electrostatic latent image, and the developer and the voltages are the same for printing on both opaque and transparent substrates and the apparatus provides images on the opaque and transparent substrates that have substantially equal apparent color saturation when the opaque substrates are directly viewed and the transparent substrates are viewed by projection.

18. Apparatus according to claim 3 wherein the developer operates at a given development voltage for developing said electrostatic latent image, and the developer and the voltages are the same for printing on both opaque and transparent substrates and the apparatus provides images on the opaque and transparent substrates that have substantially equal apparent color saturation when the opaque substrates are directly viewed and the transparent substrates are viewed by projection.

19. Apparatus according to claim 5 wherein the developer operates at a given development voltage for developing said electrostatic latent image, and the developer and the voltages are the same for printing on both opaque and transparent substrates and the apparatus provides images on the opaque and transparent substrates that have substantially equal apparent color saturation when the opaque substrates are directly viewed and the transparent substrates are viewed by projection.

20. Apparatus according to claim 6 wherein the developer operates at a given development voltage for developing said electrostatic latent image, and the developer and the voltages are the same for printing on both opaque and transparent substrates and the apparatus provides images on the opaque and transparent substrates that have substantially equal apparent color saturation when the opaque substrates are directly viewed and the transparent substrates are viewed by projection.

21. Apparatus according to claim 7 wherein the developer operates at a given development voltage for developing said electrostatic latent image, and the developer and the voltages are the same for printing on both opaque and transparent substrates and the apparatus provides images on the opaque and transparent substrates that have substantially equal apparent color saturation when the opaque substrates are directly viewed and the transparent substrates are viewed by projection.

22. A method according to claim 8 wherein the step of developing utilizes a developer system operating at given voltages, and wherein said developer system and voltages are the same for printing on both opaque and transparent substrates and wherein the images on the opaque and transparent substrates have substantially equal apparent color saturation when the opaque substrates are directly viewed and the transparent substrates are viewed by projection.

23. A method according to claim 9 wherein the step of developing utilizes a developer system operating at given voltages, and wherein said developer system and voltages are the same for printing on both opaque and transparent substrates and wherein the images on the opaque and transparent substrates have substantially equal apparent color saturation when the opaque substrates are directly viewed and the transparent substrates are viewed by projection.

24. A method according to claim 10 wherein the step of developing utilizes a developer system operating at given voltages, and wherein said developer system and voltages are the same for printing on both opaque and transparent substrates and wherein the images on the opaque and transparent substrates have substantially equal apparent color saturation when the opaque substrates are directly viewed and the transparent substrates are viewed by projection.

25. A method according to claim 11 wherein the step of developing utilizes a developer system operating at given voltages, and wherein said developer system and voltages are the same for printing on both opaque and transparent substrates and wherein the images on the opaque and transparent substrates have substantially equal apparent color saturation when the opaque substrates are directly viewed and the transparent substrates are viewed by projection.

26. A method according to claim 12 wherein the step of developing utilizes a developer system operating at given voltages, and wherein said developer system and voltages are the same for printing on both opaque and transparent substrates and wherein the images on the opaque and transparent substrates have substantially equal apparent color saturation when the opaque substrates are directly viewed and the transparent substrates are viewed by projection.

27. A method according to claim 13 wherein the step of developing utilizes a developer system operating at given voltages, and wherein said developer system and voltages are the same for printing on both opaque and transparent substrates and wherein the images on the opaque and transparent substrates have substantially equal apparent color saturation when the opaque substrates are directly viewed and the transparent substrates are viewed by projection.

28. Apparatus according to claim 1, wherein the control apparatus includes means for automatically determining if the substrate to be printed is opaque or transparent.

29. Apparatus for providing image on either opaque or transparent substrates, comprising:

a marking device which deposits only a given amount of pigmented material in an imagewise configuration on the substrate when the substrate is opaque and which deposits twice the given amount when the substrate is transparent.

30. A method for providing an image on either opaque or transparent substrates, comprising the step of:

depositing only a given amount of colored material in an imagewise configuration on an opaque substrate when the substrate is opaque and depositing twice the given amount when the substrate is transparent.

* * * * *

UNITED STATES PATENT AND TRADEMARK OFFICE

CERTIFICATE OF CORRECTION

PATENT NO. : 5,380,611
DATED : January 10, 1995
INVENTOR(S) : Benzion LANDA

It is certified that error appears in the above-indentified patent and that said Letters Patent is hereby corrected as shown below:

At column 2, line 34, change "The" to ---There---.

At column 3, line 19, change "taken conjunction" to ---taken in conjunction---.

At column 3, line 34, change "powder liquid" to ---powder or liquid---.

At column 3, line 45, change "with positive" to ---with a positive---.

At column 3, line 46, change "surface 6" to ---surface 16---.

At column 5, line 43, change "the is" to ---the light is---.

At column 7, line 29 (claim 12, line 1), change "claim 8" to ---claim 9---.

At column 7, line 66 (claim 16, line 1), change "claim 4" to ---claim 2---.

Signed and Sealed this

Sixteenth Day of May, 1995

*Attest:*

*Attesting Officer*

BRUCE LEHMAN

*Commissioner of Patents and Trademarks*